United States Patent [19]

Kuhlmann

[11] 4,445,220

[45] Apr. 24, 1984

[54] COVER FOR CASTING LADLE

[75] Inventor: Herbert Kuhlmann, Bochum, Fed. Rep. of Germany

[73] Assignee: SIDEPAL S.A. Societe Industrielle de Participation Luxembourgeoise, Luxembourg, Luxembourg

[21] Appl. No.: 351,872

[22] Filed: Feb. 24, 1982

[30] Foreign Application Priority Data

Nov. 28, 1981 [DE] Fed. Rep. of Germany ..... 3147337

[51] Int. Cl.[3] ..... F27D 1/02; F27D 1/12

[52] U.S. Cl. ..... 373/74

[58] Field of Search ..... 373/74; 432/250; 266/280, 286; 110/331, 335

[56] References Cited

FOREIGN PATENT DOCUMENTS 1816488 6/1970 Fed. Rep. of Germany ..... 373/74

2048445 12/1980 United Kingdom ..... 373/74

*Primary Examiner*—Roy N. Envall, Jr.

*Attorney, Agent, or Firm*—Karl F. Ross; Herbert Dubno

[57] ABSTRACT

A cover for a metallurgical vessel has a top part formed as a flat, generally circular, and normally horizontal array of tubes having an outer edge and forming a plurality of vertically throughgoing passages. These tubes extend mainly angularly of the center of the array. Respective pluralities of annular tubes at and extending around the passages are connected with each other at the center and with the tubes of the flat array. This top part has a skirt formed as an annular array of generally vertical tubes extending downwardly from the outer edge and connected with the tubes of the flat array. Respective partially circularly annular collars at the passages on the flat array have inwardly directed closely juxtaposed ends. The collars and tubes are connected together as a rigid assembly. A coolant is circulated through the tubes.

6 Claims, 2 Drawing Figures

COVER FOR CASTING LADLE

FIELD OF THE INVENTION

The present invention relates to a cover for a metallurgical vessel. More particularly this invention concerns a cover for a casting ladle.

BACKGROUND OF THE INVENTION

A cover for a metallurigcal crucible in which metal is melted or treated in molten condition normally must be cooled to protect it from the extremely high temperatures reigning in the vessel or crucible. Accordingly it is standard to make such a cover as an annular and tubular outer ring or collar supporting an array of cooling tubes and to circulate a coolant such as water or steam through the collar and tubes.

It is frequently necessary to provide one or more holes in the cover so that a lance or electrodes can be inserted through it, and so that material may be introduced into the crucible through the cover. In an electric-arc casting ladle in particular it is necessary to provide three such openings for the electrodes of a standard three-phase system as well as at least one opening for introduction of material into the crucible. The electrodes heat up a great deal themselves, so it is standard practice to provide relatively large openings formed by substantial metallic rings in good heat-transmitting engagement with the cooling tubes, and to use a separate cooled jacket on each electrode. Thus each electrode with its own cooling device is fitted to the respective ring.

It has also been suggested in British Pat. No. 2,048,445 to use a refractory center piece in the cover, and to form it with the necessary electrode holes. A coolable structural element constituting an inner collar supports such a refractory center piece. Such an arrangement, although in principal substantially simpler than the other above-described system, has a relatively short service life because the ceramic insert and the metallic cover have different coefficients of thermal expansion. Thus as they heat and cool they work against each other, normally with the result of cracking the insert.

In order to make such arrangements structurally strong, it is normally necessary to build them of large-diameter load-supporting frame tubes, and to use smaller-diameter cooling tubes that extend between these frame tubes. As a result their construction is quite complex.

OBJECTS OF THE INVENTION

It is therefore an object of the present invention to provide an improved cover for a metallurgical vessel.

Another object is the provision of such a cover for a metallurgical vessel which overcomes the above-given disadvantages.

A further object is to provide a cover for a casting ladle which is substantially simpler in construction than the prior-art arrangements.

SUMMARY OF THE INVENTION

These objects are attained according to the instant invention in a cover for a metallurgical vessel which has a top part formed as a flat, generally circular, and normally horizontal array of tubes having an outer edge and forming a plurality of vertically throughgoing passages. These tubes extend mainly angularly of the center of the array. Respective pluralities of annular tubes at and extending around the passages are connected with each other at the center and with the tubes of the flat array. This top part has a skirt formed as an annular array of generally vertical tubes extending downwardly from the outer edge and connected with the tubes of the flat array. Respective partially circularly annular collars at the passages on the flat array have inwardly directed closely juxtaposed ends. Means is provided for connecting the collars and tubes together as a rigid assembly and for circulating a coolant through the tubes.

The structure according to the instant invention is therefore a self-supporting assembly which does not need a separate frame. The angularly extending cooling tubes act like a dome or arch to support the assembly. Such an arrangement is particularly applicable to a pouring or casting ladle which is usually relatively small. With such an arrangement it is possible to cool the cover adequately, even when the device is used for various metallurgical treatments.

According to this invention the passages are generally radially and angularly equispaced about the center. This makes these passages ideal for electrodes, in which case normally three such holes are provided for a standard three-phase source.

The connecting means according to this invention includes welds between the tubes and collars. It can also include metal strips welded atop the tubes of the flat array. Either way the tubes are all rigidly connected together to eliminate the need for a separate support frame. The connecting means can also include auxiliary elements secured to the tubes of the flat and annular arrays.

The tubes are normally all of substantially the same relatively small diameter, making the entire assembly relatively light.

DESCRIPTION OF THE DRAWING

The above and other features and advantages will become more readily apparent from the following, reference being made to the accompanying drawing in which.

SPECIFIC DESCRIPTION

Figure 2:
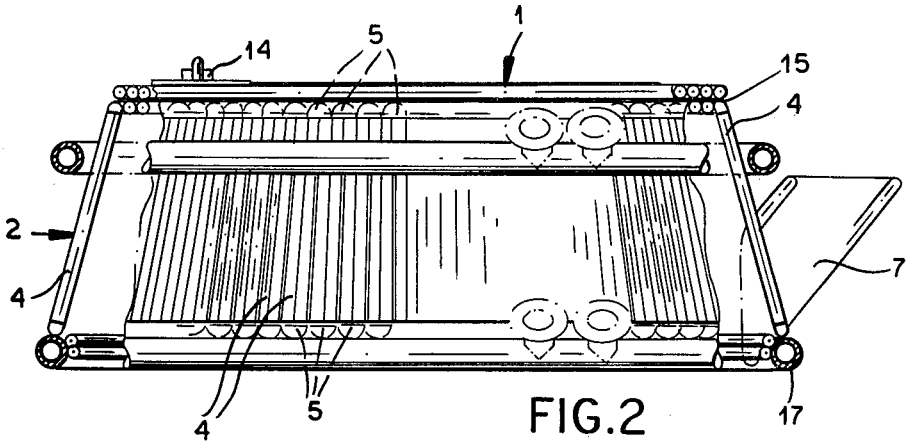
FIG. 2 is a top view of the cover of FIG. 1.
Figure 1:
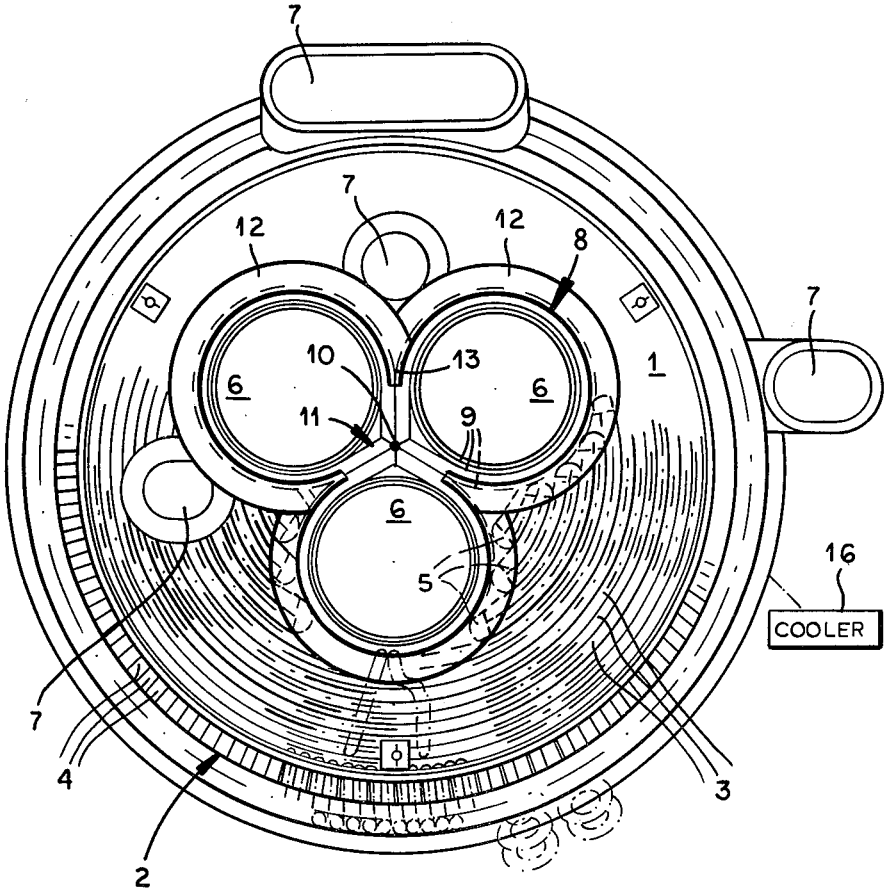
FIG. 1 is a side partly sectional view of the cover of this invention.

As seen in the drawing a cover has a planar top 1 with a center 10 and formed by a multiplicity of circularly arcuate and angularly extending tubes 3, and a rim 2 formed by a multiplicity of generally straight and vertically extending tubes 4. The tubes 3 have ends interconnected by caps 5 so that a cooler 16 can circulate a coolant such as water or steam through these tubes 3 as well as through the tubes 4, which latter extend up from a main annular manifold tube 17.

The top 1 is formed with three circular throughgoing holes or passages 6 radially equispaced from and angularly equispaced around the center 10. Several superposed annular tubes 9 line each of these holes 6 as well as respective L-section collars 8 having upper flanges 12 that lie atop the tubes 3. These upper flanges 12 are not completely circular, but have overlapping inwardly directed pointed ends 13 that together form a Y-shaped core piece 11. The tubes 9 are connected together at the center 10 and are also connected to the tubes 3 so that the coolant can flow through them also.

In addition to the passages 6 the top 1 is provided with several throughgoing feed tubes 7 suitable for inserting a lance into the interior of a vessel atop which the device fits, or for pouring some substance into such vessel.

The tubes 3 and 4 normally engage one another laterally and are welded together. In addition thin strips or plates 15 may be provided to connect the arrangement together into a rigid assembly, and auxiliary elements 14 may be provided so that the device is dimensionally stable. To this end the various tubes 3 are braced against each other so that the assembly is fully self-supporting, like an arch or dome. The tubes 3 extend right up to the edges of the holes 6 and 7 so that the entire cover is adequately protected.

This arrangement is substantially lighter than any prior-art such devices. It will nonetheless ensure adequate cooling of the cover so that it will have a long service life.

I claim:

1. A cover for a metallurgical vessel, said cover comprising:

a flat, generally circular, and normally horizontal array of tubes having an outer edge and forming a plurality of vertically throughgoing passages, said tubes extending mainly angularly of the center of said array;

respective pluralities of annular tubes at and extending around said passages and connected with each other at said center and with the tubes of said flat array;

an annular array of generally vertical tubes extending downward from said outer edge and connected with the tubes of said flat array;

respective partially circularly annular collars at said passages on said flat array and having inwardly directed closely juxtaposed ends;

means for connecting said collars and tubes together as a rigid assembly capable of supporting itself on the metallurgical vessel; and means for circulating a coolant through said tubes.

2. The cover defined in claim 1 wherein said passages are generally radially and angularly equispaced about said center.

3. The cover defined in claim 2 wherein the connecting means includes welds between said tubes and collars.

4. The cover defined in claim 3 wherein said connecting means includes metal strips welded atop said tubes of said flat array.

5. The cover defined in claim 2 wherein said connecting means includes auxiliary elements secured to said tubes of said flat and annular arrays.

6. The cover defined in claim 1 wherein said tubes are all of substantially the same diameter.

* * * * *